US005641926A

United States Patent [19]

Gibson et al.

[11] Patent Number: 5,641,926

[45] Date of Patent: Jun. 24, 1997

[54] METHOD AND APPARATUS FOR CHANGING THE TIMBRE AND/OR PITCH OF AUDIO SIGNALS

[75] Inventors: Brian C. Gibson; Christopher M. Jubien; Brian J. Roden, all of Victoria, Canada

[73] Assignee: IVL Technologis Ltd., Victoria, Canada

[21] Appl. No.: 720,447

[22] Filed: Sep. 30, 1996

Related U.S. Application Data

[63] Continuation of Ser. No. 374,110, Jan. 18, 1995, Pat. No. 5,567,901.

[51] Int. Cl.[6] ..... G10H 7/00

[52] U.S. Cl. ..... 84/603; 84/605; 84/619

[58] Field of Search ..... 84/603–605, 619, 84/62, 659; 381/49; 395/2.14

[56] References Cited

U.S. PATENT DOCUMENTS

| | | | |
|---|---|---|---|
| 3,929,051 | 12/1975 | Moore . | |
| 3,986,423 | 10/1976 | Rossum . | |
| 3,999,456 | 12/1976 | Tsunoo et al. . | |
| 4,076,960 | 2/1978 | Buss et al. . | |
| 4,081,607 | 3/1978 | Vitols et al. . | |
| 4,142,066 | 2/1979 | Ahamed . | |
| 4,279,185 | 7/1981 | Alonso . | |
| 4,311,076 | 1/1982 | Rucktenwald et al. . | |
| 4,387,618 | 6/1983 | Simmons, Jr. . | |
| 4,464,784 | 8/1984 | Agnello . | |
| 4,508,002 | 4/1985 | Hall et al. . | |
| 4,519,008 | 5/1985 | Takenouchi et al. . | |
| 4,596,032 | 6/1986 | Sakurai . | |
| 4,688,464 | 8/1987 | Gibson et al. . | |
| 4,771,671 | 9/1988 | Hoff, Jr. . | |
| 4,802,223 | 1/1989 | Lin et al. . | |
| 4,915,001 | 4/1990 | Dillard . | |
| 4,991,218 | 2/1991 | Kramer . | |
| 5,048,390 | 9/1991 | Adachi et al. . | |
| 5,054,360 | 10/1991 | Lisle et al. . | |
| 5,056,150 | 10/1991 | Yu et al. . | |
| 5,231,671 | 7/1993 | Gibson et al. | 395/2 X |

*Primary Examiner*—William M. Shoop, Jr.
*Assistant Examiner*—Jeffrey W. Donels
*Attorney, Agent, or Firm*—Christensen O'Connor Johnson & Kindness PLLC

[57] ABSTRACT

A method for shifting the timbre and/or pitch of an input signal samples the input signal at a first rate and stores the samples in a memory buffer. A digital signal processor resamples the stored input signal at a rate that differs from the first rate at which the input note is originally sampled and stores the resampled input signal in a second memory buffer. A pitch shifter shifts the pitch of the input signal by periodically scaling the resampled input signal by a window function to create an output signal. The rate at which the resampled data is replicated by the window function determines the pitch of the output signal.

23 Claims, 11 Drawing Sheets

METHOD AND APPARATUS FOR CHANGING THE TIMBRE AND/OR PITCH OF AUDIO SIGNALS

This application is a continuatoin of application Ser. No. 08/374,110, filed Jan. 18, 1995 to issue Oct. 22, 1996 as U.S. Pat. No. 5,567,901.

FIELD OF THE INVENTION

The present invention relates generally to electronic audio effects and in particular to musical effects that shift the timbre and/or pitch of audio signals.

BACKGROUND OF THE INVENTION

In any periodic musical note, there is always a fundamental frequency that determines the particular pitch of the note, as well as numerous harmonics which provide character or timbre to the musical note. It is the particular combination of the harmonic frequencies with the fundamental frequency that make, for example, a guitar and a violin playing the same note sound different from one another. The relationship of the amplitude of the fundamental frequency component to the amplitude of the harmonics created by an instrument is referred to as the spectral envelope. In a musical instrument such as a guitar, flute, or saxophone, the spectral envelope of a note played by the instrument expands and contracts more or less proportionally as the pitch of the note is shifted up or down.

Electronic pitch shifters are musical effects that receive an input note and produce an output note with a different pitch. Such effects are often used to allow a single musician to sound like several. For musical instruments, one can change the pitch of a note by sampling the sound from the instrument and playing back the sampled sounds at a rate that is either faster or slower than the rate at which the samples were recorded. The output notes created by this technique sound fairly natural because the spectral envelope of the pitch shifted sounds mimics how the spectral envelope of the sounds produced by the instrument vary with pitch.

In contrast to notes produced by musical instruments, the spectral envelope of vocal notes or sounds do not vary proportionately as the pitch of the vocal note varies. However, the relative magnitudes of the individual frequencies that make up this spectral envelope may change. Shifting the pitch of a vocal note by sampling a note as it is sung or spoken and playing the samples back at a different speed does not sound natural because the method varies the shape of the spectral envelope in proportion to the amount of pitch shift. In order to realistically shift the pitch of a vocal sound, a method is required for varying the frequency of the fundamental while only slightly varying the overall shape of the spectral envelope.

A device that shifts the pitch of vocal notes to create harmonies in real time is described in our prior U.S. Pat. No. 5,231,671 (the "'671 patent", the specification of which is herein incorporated by reference). The method of pitch shifting described in the '671 patent was adapted from an article, Lent, K. "An Efficient Method for Pitch Shifting Digitally Sampled Sounds," *Computer Music Journal*, Volume 13, No. 4, (1989) (also incorporated by reference herein, and hereafter referred to as the Lent method). The Lent method allows the pitch of a digitally sampled sound to be shifted without changing the spectral envelope. Briefly stated, the Lent method can be used to shift the pitch of a vocal note by replicating portions of a stored input signal at a rate that is faster or slower than the fundamental frequency input note. While this method of shifting the pitch of vocal notes works well, the pitch shifted notes do not sound completely natural, because the spectral envelope remains fixed as the pitches of the notes are varied.

As described above, there are two methods of electronically shifting the pitch of a note. The first method, referred to as resampling, modifies the spectral envelope in proportion to the amount of pitch shift. The Lent method more or less maintains the spectral envelope regardless of the amount of pitch shift. Neither of these two methods allow the spectral envelope to be varied in a controllable manner. Therefore, there is a need for a method of altering the spectral envelope of a musical note that is not dependent on the pitch of a note. With such a method, more realistic harmonies can be created. In addition, by changing the timbre of the note with or without changing the output pitch, it is possible to make one instrument sound like another, or one person's voice sound like another.

SUMMARY OF THE INVENTION

To shift the timbre of both vocal notes and notes produced by musical instruments, the present invention uses a novel combination of pitch shifting by altering the sampling rate of a signal and pitch shifting according to the Lent method. In the preferred embodiment, the input signal is sampled at a first rate, and the resulting digital representation is stored in a memory buffer. The stored digital input signal is then resampled at a second rate that is determined by a user. The resampled input signal is then stored in a second memory buffer. The pitch of the resampled input signal is then shifted by scaling the resampled input signal with a window function at a rate equal to the fundamental frequency of the output note desired. If it is desired to only shift the timbre of a note and not the pitch of a note, then the rate at which the resampled input signal is scaled with the window function is the same as the fundamental frequency of the input note. If it is desired to change the pitch of the output note as well as its timbre, then the rate at which the resampled input signal is scaled with the window function differs from the fundamental frequency of the input note.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention provides a system for shifting the timbre of a note in a way that sounds more realistic than timbre shifts produced by known systems. In its simplest form, the method can be used to shift the timbre of a note but not the pitch of a note. For example, the method can be used to make a vocal signal sung or spoken by a man sound as if the same note were sung or spoken by a woman. In addition to shifting the timbre of a note, the method of the present invention can be used to change the pitch and timbre of a note. For example, the present invention can be used to make a note sung by a woman sound like another note sung by a man. Finally, the presently preferred embodiment of the invention is used to create timbre shifted, harmony notes from an input note. Although the following description is primarily directed to producing harmony notes from an input vocal note, it will be realized that the note need not be a vocal note but may be produced from any source, and the output note need not be different from or harmonious with the input pitch.

Figure 1A:
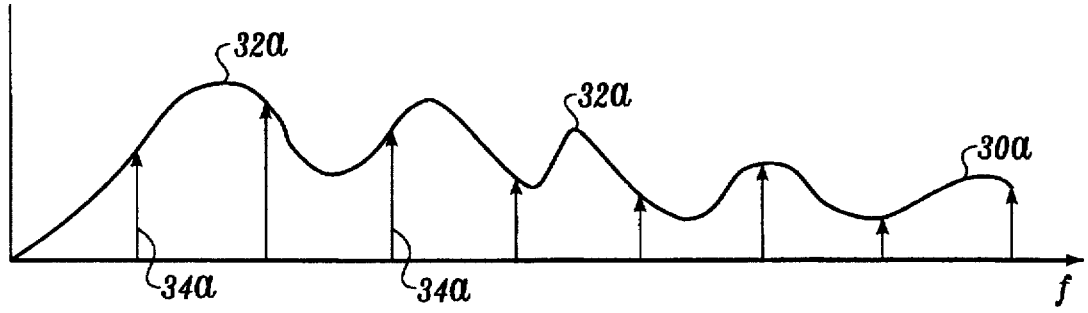
FIGS. 1A–1D are representative graphs of the spectra of vocal signals showing how the spectral envelopes change as a result of prior art timbre/pitch shifting techniques as well as the timbre/pitch shitting technique of the present invention.

FIGS. 1A–1D compare how the spectral envelope of a vocal note changes when the pitch of the note is shifted according to prior art techniques and by the method of the present invention. FIG. 1A shows a frequency spectrum 30*a* that is representative of a typical vocal note. The overall shape of the spectrum is defined by one or more formants or peaks 32*a*. The character or timbre of the vocal note is defined by the relative magnitude and position of the fundamental frequency of the note and the harmonics (represented by the arrows 34*a*).

Figure 1B:
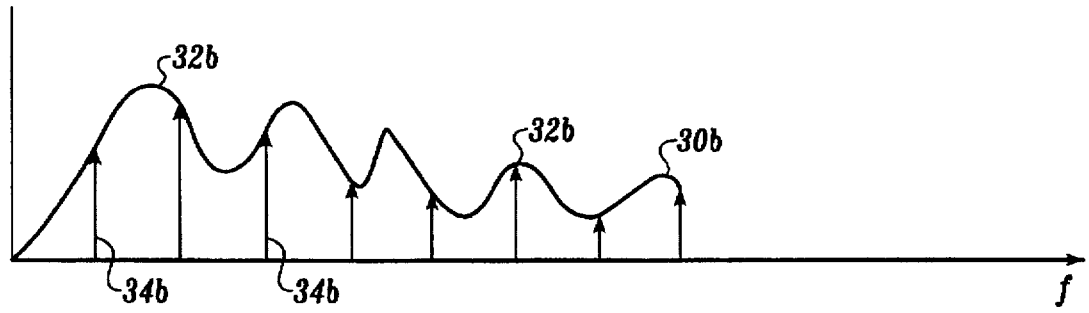

To realistically shift the pitch of a vocal note, it is necessary to shift the fundamental frequency of a note while maintaining the formants of the spectrum close to those of the original vocal note. FIG. 1B shows a spectrum 30*b* of a pitch shifted vocal note that is a musical fifth below the note associated with the spectrum shown in FIG. 1A. The note associated with the spectrum 30*b* was created by slowing the playback rate of the sampled original vocal note. As can be seen, the entire spectral envelope defined by the formants 32*b* as well as the individual harmonics 34*b* is compressed and shifted to a lower frequency. The result of shifting the formants makes the pitch shifted vocal note sound unnatural.

Figure 1C:
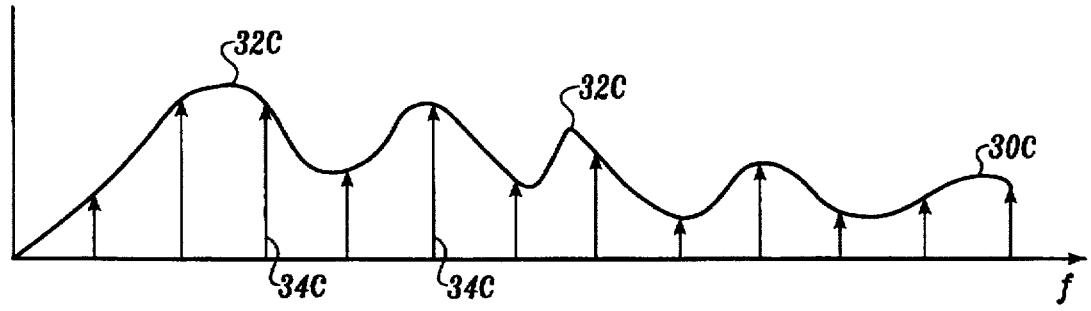

FIG. 1C shows a spectrum 30*c* of a pitch shifted vocal note that is a musical fifth below the note associated with spectrum shown in FIG. 1A and which was generated in accordance with the method set forth in the '671 patent. The pitch shifted vocal note associated with the spectrum 30*c* was created by replicating a portion of the input vocal note at a rate that is slower than the fundamental frequency of the original input vocal note. In the spectrum 30*c*, only the frequencies of the harmonics 34*c* have changed, as described in the '671 patent. The overall shape of the spectrum remains the same as the spectrum shown in FIG. 1A. The pitch shifted vocal note associated with the spectrum 30*c* sounds more natural than the pitch shifted vocal note produced by the note associated with the spectrum 30*b* shown in FIG. 1B. However, the pitch shifted vocal note does not sound completely natural. Pitch shifted vocal notes produced by the method described in the '671 patent tend to have timbres that are very similar to the input vocal signal from which they are created. Therefore, all the pitch shifted vocal notes sound like altered variations of the original.

To alter the timbre of a note in a manner that sounds realistic, the present invention uses a novel combination of resampling pitch shitting, whereby the playback rate of the vocal note is altered, and the method described in the '671 patent. The result is a timbre shifted note that can be made to sound deeper and more masculine, or higher and more feminine.

Figure 1D:
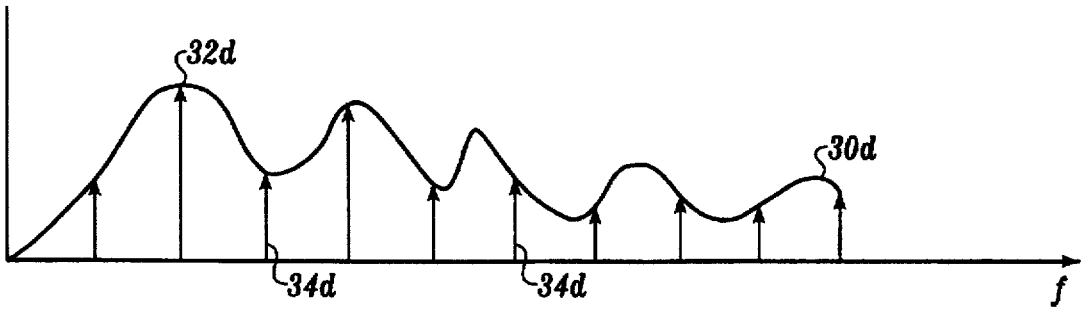

FIG. 1D shows a spectrum 30*d* of a pitch shifted vocal note having a frequency that is a musical filth below the input vocal note associated with the spectrum shown in FIG. 1A, and which was generated in accordance with the present invention. As will be described in further detail, the pitch shifted vocal note corresponding to the spectrum 30*d* was obtained by resampling the previously stored input vocal note at a rate that is slightly slower than the original sampling rate and storing the resampled data in a memory buffer. A portion of the resampled data is then replicated at a rate equal to the fundamental frequency of the musical fifth below the pitch of the input note. As can be seen, the spectrum 30*d* is slightly compressed but similar to the original spectrum 30*a*. The result is a pitch shifted vocal note that sounds natural but not like a replicated version of the original input note.

Figure 2A:
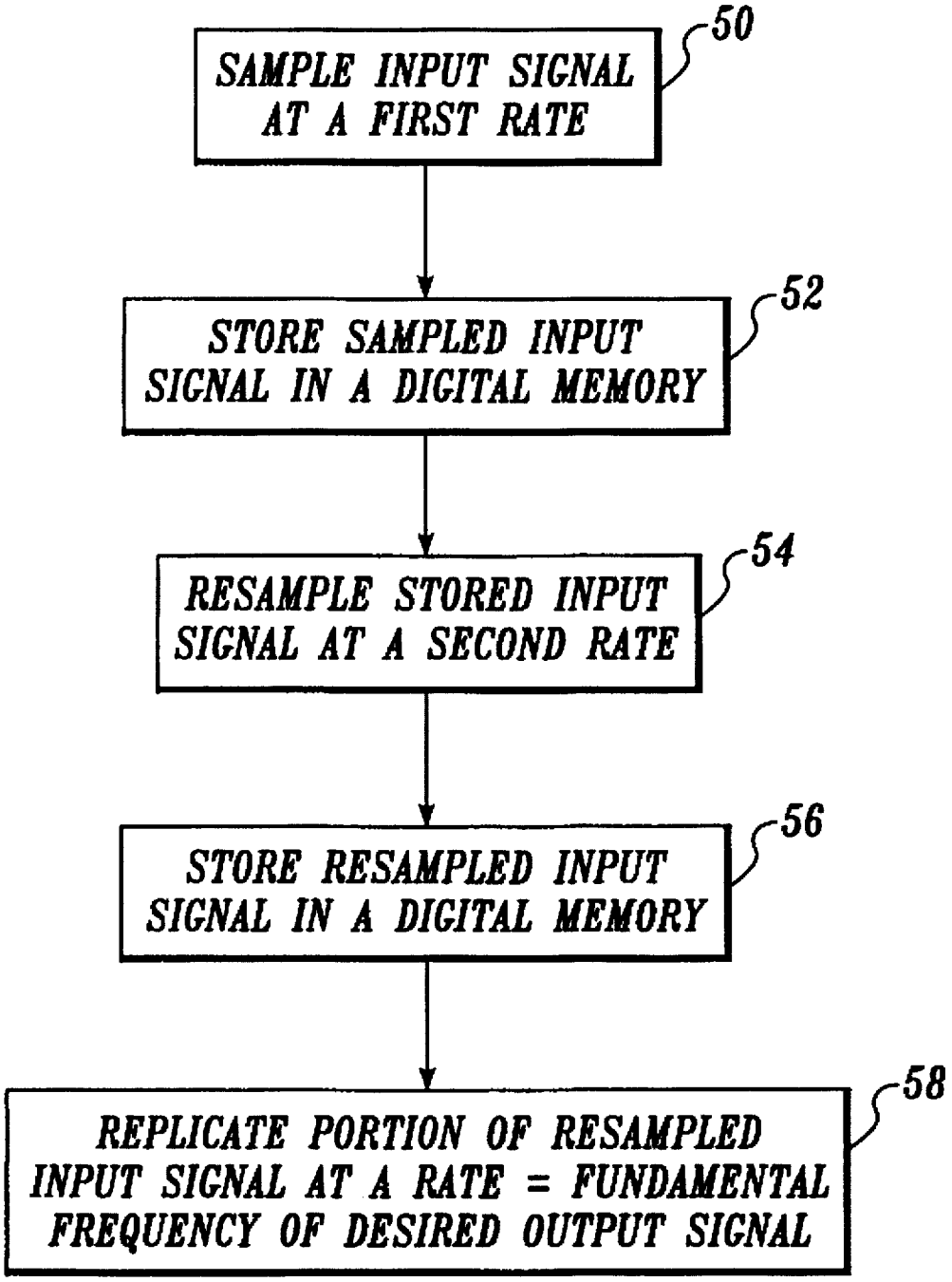
FIG. 2A is a flow chart of the steps performed by the present invention to shift the timbre and/or pitch of an input note.

The major steps of the present invention to create a timbre and/or pitch shifted output signal from an input signal are set forth in the flowchart shown in FIG. 2A. The method begins at a step 50 where an input signal is sampled at a first rate by a analog-to-digital converter. The input signal may be produced from a musical instrument such as a flute, guitar, etc., may be a vocal note that is spoken or sung by a user, or may be produced by a digital source such as a synthesizer. After sampling the input signal, the corresponding digital representation of the input signal is stored in a digital memory at a step 52. Next, the stored input signal is resampled at a second rate that differs from the first rate at which the input signal was originally sampled. The resampling rate may be fixed at some percentage greater than or less than the original sampling rate. Alternatively, the resampling rate may be selected by the user.

The resampled data is stored in a digital memory at a step 56. Finally, the timbre shifted output signal is produced at a step 58 by replicating a portion of the resampled data at a rate equal to the fundamental frequency of the desked output signal. For example, if it is only desired to change the timbre of an input signal, then the rate at which the portion of the resampled data is replicated is equal to the fundamental frequency of the input signal. Alternatively, it may be desired to change the timbre and pitch of the input signal, in which case the rate at which the portion of the resampled data is replicated is not the same as the fundamental frequency of the input signal. Finally, for the case in which the method of the present invention is used in harmony effect generators, the rate at which the portion of the resampled data is replicated is set to a fundamental frequency that is harmonically related to the fundamental frequency of the input signal.

In the current implementation of the invention, the timbre shifting technique is used to create harmony notes from input vocal notes sung by a user. Therefore, although the following description is directed to producing timbre shifted, vocal harmony notes, it will be appreciated that the method of the present invention can also be used to vary only the timbre of an input signal or to vary the timbre and pitch of an input signal in a way that is not harmonically related to the pitch of the input signal.

Figure 2B:
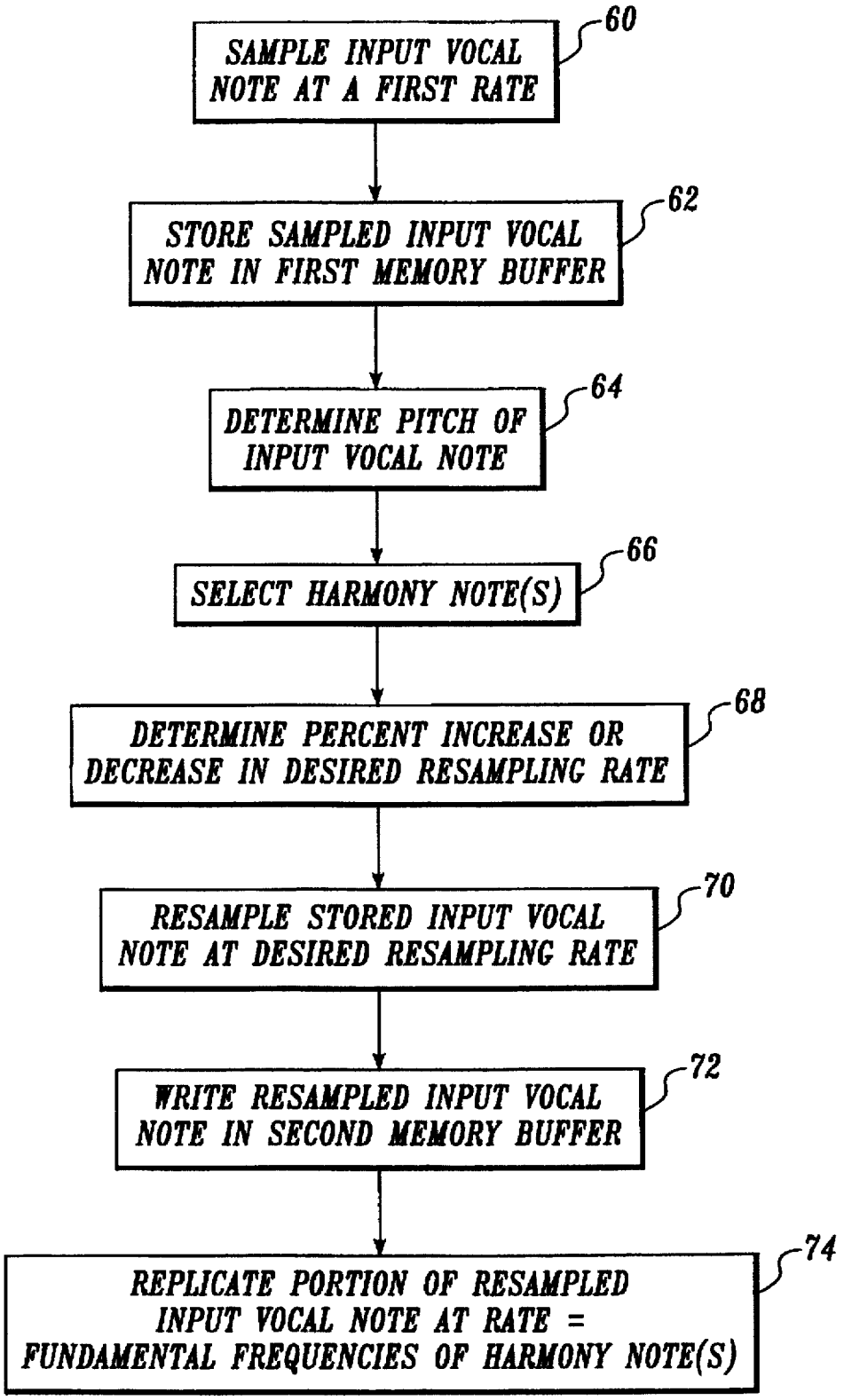
FIG. 2B is a flow chart of the steps performed by the present invention to create timbre shifted, harmony notes from an input vocal note.

FIG. 2B is a flow chart of the major steps performed in the present invention to produce timbre shifted, vocal harmonies. The method begins at a step 60 wherein the analog input vocal note is sampled and digitized at a first rate. At a step 62, the digital samples are stored in a first memory buffer. At a step 64, the stored samples are analyzed to determine the pitch of the input vocal note. After the pitch has been determined, the harmony notes to be produced with the input vocal note are selected at a step 66. The particular harmony notes produced for a given input note may be preprogrammed, individually selected by a user, or may be received from an external source such as a synthesizer, a sequencer, or an external storage device such as a computer disk, a laser disk, etc.

After the harmony notes are selected, the percent increase or decrease of the sampling rate that has been selected by a user is determined at a step 68. The sampling rate may be increased to give the harmony notes a more feminine quality, or decreased to produce harmony notes with a more masculine sound.

At a step 70, the digitized input vocal note that was stored in step 62 is resampled at the new rate selected by the user. The resampled data are stored in a second memory buffer. For example, if the user has selected to decrease in the sampling rate, then there will be fewer data samples in the second memory buffer, thereby decreasing the amount of memory required to store the digitized input vocal note. Similarly, if the user has selected to increase the sampling rate, the data of the first buffer will be resampled at a higher rate than the rate at which the data were originally sampled, thereby requiring more samples and increasing the amount of memory required to store the digitized input vocal note in the second buffer. With the data occupying more memory space, the pitch of the note will be lowered, assuming that the rate at which the samples are read from memory remains the same.

The resampled data is stored in a second memory buffer at a step 72. Finally, the harmony notes are created at a step 74 by replicating portions of the resampled input vocal note at rates that are equal to the fundamental frequencies of the harmony notes selected in step 66.

Figure 3:
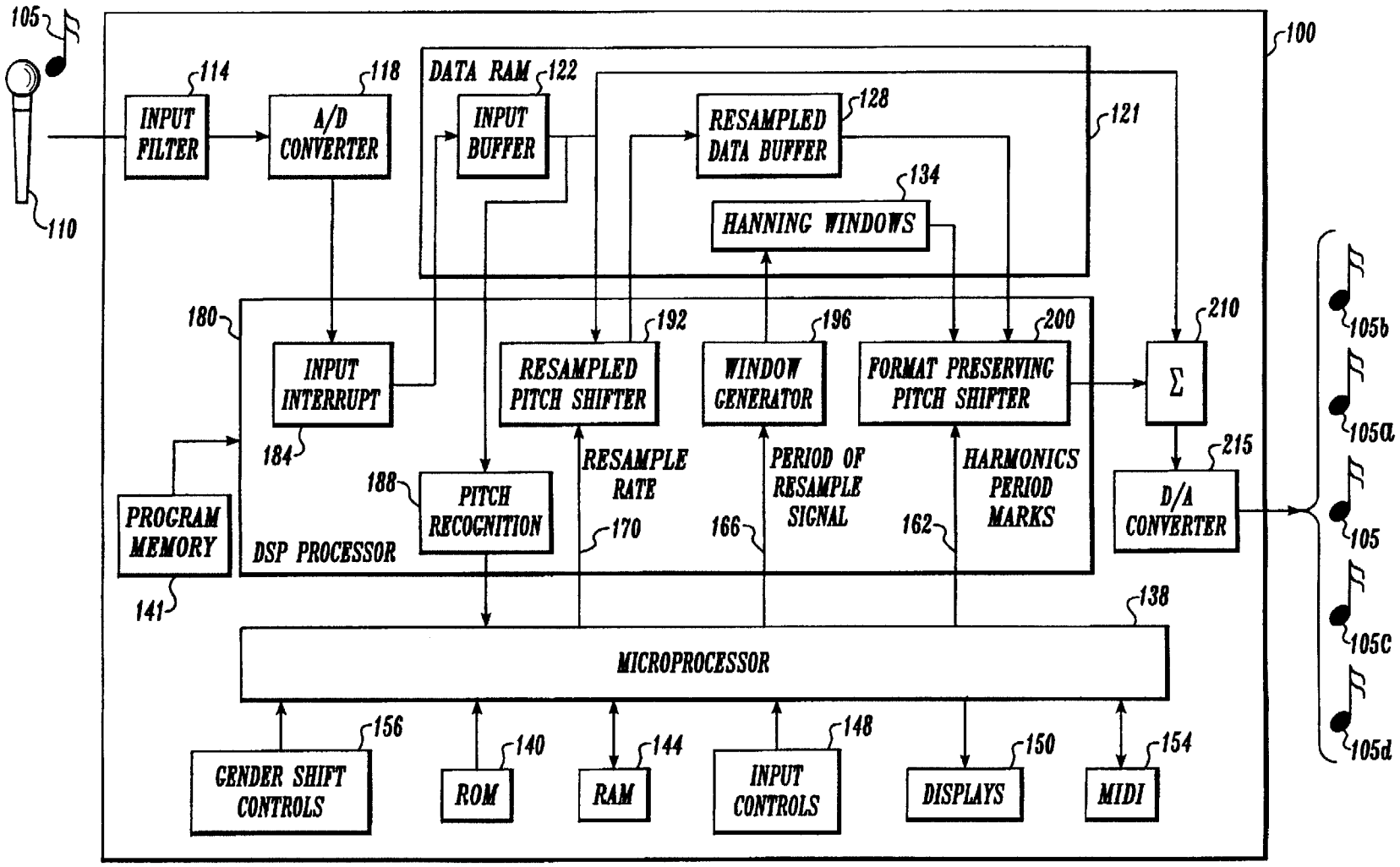
FIG. 3 is a block diagram of a musical effect generator for producing vocal harmonies according to the method of the present invention.

Turning now to FIG. 3, a musical effect generator 100 that produces timbre shifted, harmony notes according to the method of the present invention receives an input vocal note 105 that is sung by a user. In general, the effect generator has a microprocessor or CPU 138 that is interfaced with a digital signal processor (DSP) 180 and random access memory (RAM) 121 to produce a number of harmony notes 105*a*, 105*b*, 105*c*, and 105*d* that are combined with the input vocal note to produce a multi-voice output, as described in detail below.

The microprocessor 138 includes its own read only memory (ROM) 140 and random access memory (RAM) 144. A set of input controls 148 are coupled to the microprocessor to allow a user to vary the operating parameters of the musical effect generator. These parameters include selecting which harmony notes will be produced for a given input note and the distribution of the harmony notes between a right and left stereo channel.

A set of displays 150 are operated by the microprocessor. The displays provide a visual indication of how the effect generator is operating and what options have been selected by the user. One or more MIDI ports 154 are coupled to the microprocessor to allow the effect generator to receive MIDI data from other MIDI-compatible instruments or effects. The details of a MIDI port are well known to those of ordinary skill in the art and therefore need not be discussed in further detail.

Finally, the effect generator includes a pair of "gender shift" controls 156. The gender shift controls allow a user to select the amount of resampling pitch shift that will be applied to each harmony note produced. The operation of the gender shift controls is more fully discussed below.

The digital signal processor 180 is a specialized computer chip that performs a variety of functions. The program code to operate the digital signal processor resides in a ROM 141 that is part of the ROM 140 coupled to the microprocessor. Upon startup of the effect generator, the microprocessor 138 loads the digital signal processor with the appropriate computer program to generate the harmony notes according to the method of the present invention.

The effect generator 100 includes a microphone 110 that receives the user's input vocal note and converts it to a corresponding analog electrical vocal signal. The input vocal signal is also referred to as the "dry" audio signal. The input vocal signal is supplied to a low pass filter 114 that removes any high frequency, extraneous noise. The filtered input vocal signal is transmitted to an analog-to-digital (A/D) converter 118 that periodically samples the input vocal signal that converts it to digital form. Each time the A/D converter has a new sample ready, it interrupts the DSP 180 causing the DSP to read the sample and store it in a first memory buffer 122 that is part of the effect generator's random access memory.

Once the input vocal signal has been sampled and stored in the first memory buffer 122, the digital signal processor 180 implements a pitch recognition routine 188 that analyzes the data stored in the memory buffer 122 and determines its pitch. The method used to determine the pitch of a note is fully described in our U.S. Pat. No. 4,688,464, which is herein incorporated by reference. For the purposes of this specification, the terms "pitch" and "fundamental frequency" of a note are interchangeable. From the pitch of the input vocal note, the period of the note is calculated.

Conventionally, the period of a note is simply the inverse of its fundamental frequency expressed in seconds. However, in the present embodiment of the invention, the period is calculated and stored in terms of the number of memory locations required to store a complete cycle of the input vocal signal. For example, one complete cycle of the note A 440 Hz occupies 109 memory locations if sampled at 48 KHz (1/440×48,000). Therefore, the period of A 440 Hz is stored as 109.

In addition to determining the pitch and period of a note, the digital signal processor also calculates a period marker which is a pointer to a location in memory where a new cycle of the input vocal signal begins. Initially, the period marker is set to point to the beginning of the memory buffer in which the input vocal is stored. Subsequent period markers are calculated by adding the number of data samples in a single cycle of the input vocal signal (i.e. one period), plus the previous period marker. The period marker is updated when a write pointer that points to the next available memory location minus a small delay is beyond where the new period marker will point. The period markers are used by the DSP 180 to produce the harmony notes, as will be described.

The results of the pitch recognition routine 188 are supplied to the microprocessor 138, i.e., a signal of the pitch of the input vocal signal stored in the first buffer 122. Within the ROM 140 of the microprocessor is a look up table that correlates the pitch of an input vocal signal with a MIDI note. In the presently preferred embodiment of the invention, each MIDI note is assigned a number between 0 and 127. For example, the note A 440 Hz is the MIDI note number 69. If an input signal is not exactly on pitch, then the note can either be rounded to the closest MIDI note or assigned a fractional number. For example, a note that is slightly flat of A 440 Hz might be assigned a number such as 68.887 by the microprocessor.

Once the microprocessor has assigned a note to the input vocal signal, the microprocessor determines which harmony notes are to be produced. The particular harmony notes produced can be individually programmed by the user or selected from one or more predefined harmony "rules." For example, a user may program the microprocessor to produce four harmony notes that are a musical third above the input note, a musical fifth above the input note, a musical seventh above the input note, and a musical third below the input note. Alternatively, the user may select a rule such as a "chordal harmony" rule that always produces harmony notes that are the chord tones above and below the input melody line. As will be appreciated, to use a rule such as the chordal harmony rule, the user inputs the chords to be sung, thereby allowing the microprocessor to determine the correct chord tones. The predefined harmony rules are stored within the ROM 140 and are actuated by the user with the input controls 148.

Another way of selecting the harmony notes to be produced is by using the MIDI port 154. Using the port, the microprocessor can receive an indication of which harmony notes to produce from an external source. These notes can be received from a synthesizer, a sequencer, or any other MIDI-compatible device. The effect generator 100 shifts the input vocal signal to have a pitch equal to the pitch of the harmony notes received. Alternatively, the instructions of which harmony notes to produce may be stored on a computer or as a subcode on a laser disk. The laser disk may operate with a karaoke or other entertainment type machine such that, as a user sings the words of a karaoke song, the karaoke machine supplies an indication of the harmony notes to be produced to the musical effect generator 100.

Once the harmony notes have been determined, the digital signal processor 180 implements a resampling subroutine 192 that resamples the input vocal signal stored in the memory buffer 122 at a rate determined by the position of the gender shift controls 156. The resampled data is stored in two memory buffers 128 that are associated with each gender shift control. By sampling at a lower rate, the timbre of the harmony notes will sound more feminine. Alternatively, if the sampling rate is raised, the harmony notes will sound more masculine.

Figure 4A:
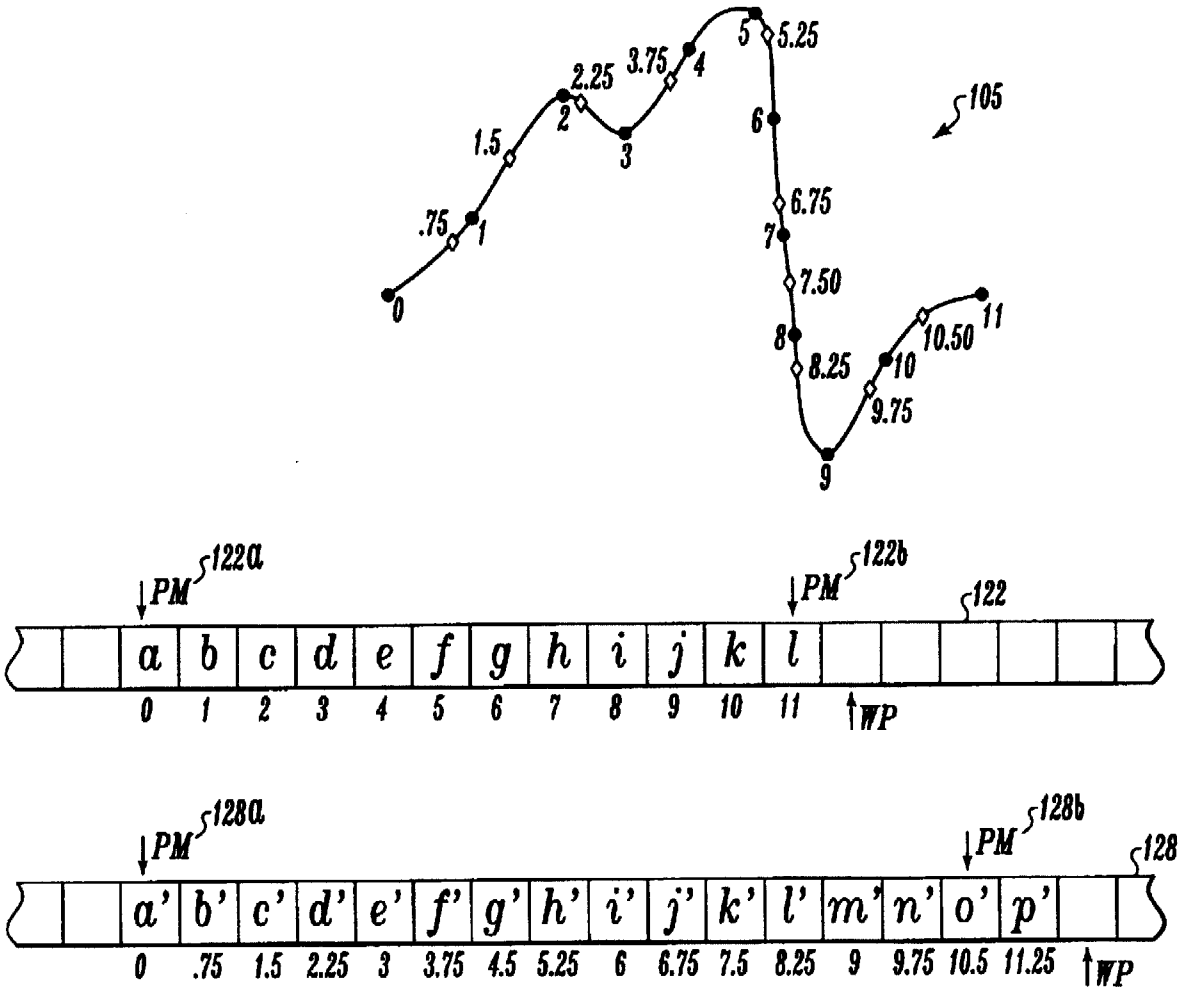
FIG. 4A and FIG. 4B are graphs and corresponding diagrammatic memory charts showing how an input vocal signal is resampled according to a step of the method of the present invention.

FIG. 4A shows how the stored input vocal data are resampled by the digital signal processor to compress the spectral envelope and make the input vocal signal sound more masculine. The analog input vocal signal 105 is sampled by the A/D converter 118 at a plurality of equal time intervals 0, 1, 2, 3, . . . , 11. Each sample has a corresponding value a, b, c, . . . , 1. The samples are sequentially stored as elements era circular array within the memory buffer 122. The circular array has a write pointer (wp) that always points to the next available memory location to be filled with new sample data. In addition, the digital signal processor also calculates the last period marker (pro) **122*b* that indicates where in the memory buffer a new cycle of the input vocal signal begins. As will be appreciated, the number of samples between the last period marker 122*b* and a previous period marker 122*a*** define one cycle of the input vocal signal.

In order to compress the spectral content of the input vocal signal, the stored signal is resampled and stored in one of the two memory buffers 128 (shown in FIG. 3) at a rate slightly higher than the rate at which it was originally sampled. The resampling rate is determined by the setting of the gender shift controls 156. In the example shown in FIG. 4A, the input vocal signal is slowed by 25 percent. This is accomplished by resampling the data that are stored in the memory buffer 122 at a time period equal to 0.75 times the original sampling period. For example, samples a', b', c', d', . . . are taken at times 0, 0.75, 1.5, 2.25, etc., and stored in the second memory buffer 128.

To calculate values for the data at times between the samples stored in the first memory buffer 122, an interpolation method is used. In the presently preferred embodiment of the invention, linear interpolation is used. For example, to fill in the data for a sample at time 0.75, the digital signal processor reads the value of the sample obtained at time 1 from memory buffer 122, multiplies it by 0.75, and adds to that 0.25 times the value of the sample obtained at time 0. Although linear interpolation is used in the currently preferred embodiment of the present invention, other more accurate interpolation methods, such as splines, could be used given sufficient computing power within the digital signal processor 180.

Once the data have been resampled and stored in the second memory buffer 128, the digital signal processor calculates a period marker **128*b* to point to the location in the memory buffer 128 where a new cycle of the resampled input vocal signal begins. The period marker 128*b* is calculated by multiplying the period marker 122*b* by the percent change in the sampling rate. Thus, the new period marker 128*b* is calculated by multiplying the period marker 122*b* by 1.33 (1/0.75) and adding the result to the previous period marker 128*a* in the second memory buffer 128. As can be seen by comparing the two memory buffers 122 and 128 shown in FIG. 4A, the effect of increasing the sampling rate of the input vocal signal increases the total number of samples required to hold a full cycle of the input vocal signal. For example, the number of samples between the two period markers 122*a* and 122*b* in the memory buffer 122 is twelve. By increasing the sampling rate by 33 percent, the number of samples required to hold an entire cycle of the input vocal signal, i.e., the number of samples between period markers 128*a* and 128*b***, increases to 16.

Figure 4B:
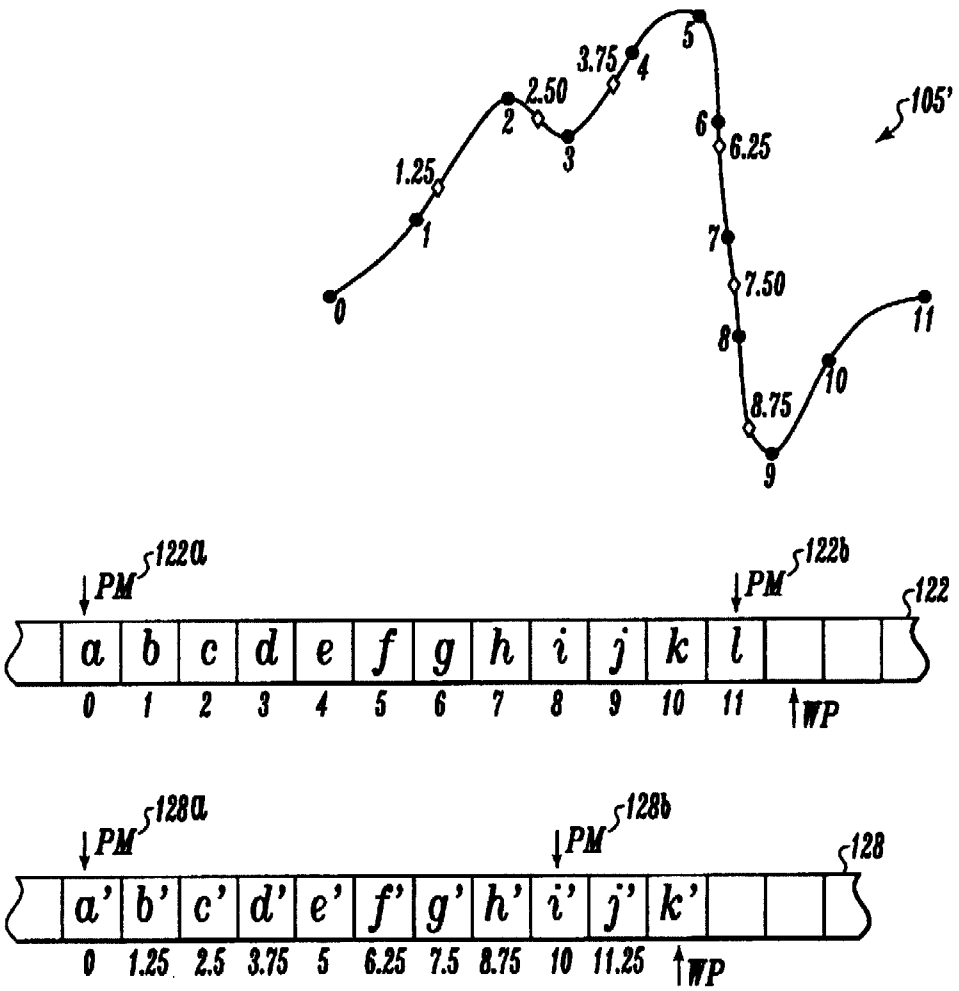

FIG. 4B shows how the input vocal signal is resampled by the digital signal processor at a rate that is slower than the rate at which the input vocal signal was originally sampled by the A/D converter 118 and stored in the memory buffer 122. Again, the analog input vocal signal 105 is sampled at a plurality of equal time intervals 0, 1, 2, 3, . . . , 11. Each sample has a corresponding value a, b, c, . . . , 1 that is stored in the first memory buffer 122. The period marker **122*b*** is calculated to point to the memory location that marks the beginning of a new cycle in the input vocal signal.

In FIG. 4B, the sampling period is shown as being increased by 25 percent. Therefore, the input vocal signal is resampled at times 0, 1.25, 2.5, 3.75, etc., times the original sampling interval. Each sample has a new value a', b', c', . . . , i'. If the sample interval does not exactly align with a one of the previously stored samples, interpolation is used to determine a value for the resampled data. For example, to calculate the value for a sample d' at time 3.75, the digital signal processor calculates the sum of 0.75 times the value of the data obtained at time 4, and 0.25 times the value of the data obtained at time 3, etc.

Again, once the data has been resampled and stored in the second memory buffer 128, the digital signal processor recalculates the last period marker 128*b* for the resampled data in the same manner as described above. As can be seen in FIG. 4B, the number of samples between the period markers 122*a* and 122*b* of the original input vocal signal is 12. When the sampling period is increased by 25 percent, only 9.6 samples exist between the period markers 128*a* and 128*b*. Therefore, the total number of samples required to store a complete cycle of the input vocal signal has decreased by 20 percent.

In the presently preferred embodiment of the present invention, a user can increase or decrease the sampling rate by +/−33%. More or less resampling shift could be provided. However, for vocal applications it has been determined that the most realistic sounding timbre shifts are obtained when the resampling rate is set between −18 and +18%.

Once the input vocal signal has been resampled at a rate indicated by the gender shift controls and stored in the data buffers 128, the DSP 180 recalculates the period of the resampled data. For example, the user may be singing an A note at 440 Hz which has a period of 2.27 milliseconds (109 samples at 48 KHz) and have one of the gender controls set to +10%. When resampled at the new rate, the period of the resampled vocal signal will be 2.043 milliseconds (98 samples at 48 KHz). This new period is used by a window generation routine 196 and to a pitch shifting routine 200 (represented in FIG. 3) that are implemented by the digital signal processor to creates the harmony notes.

Figure 7A:
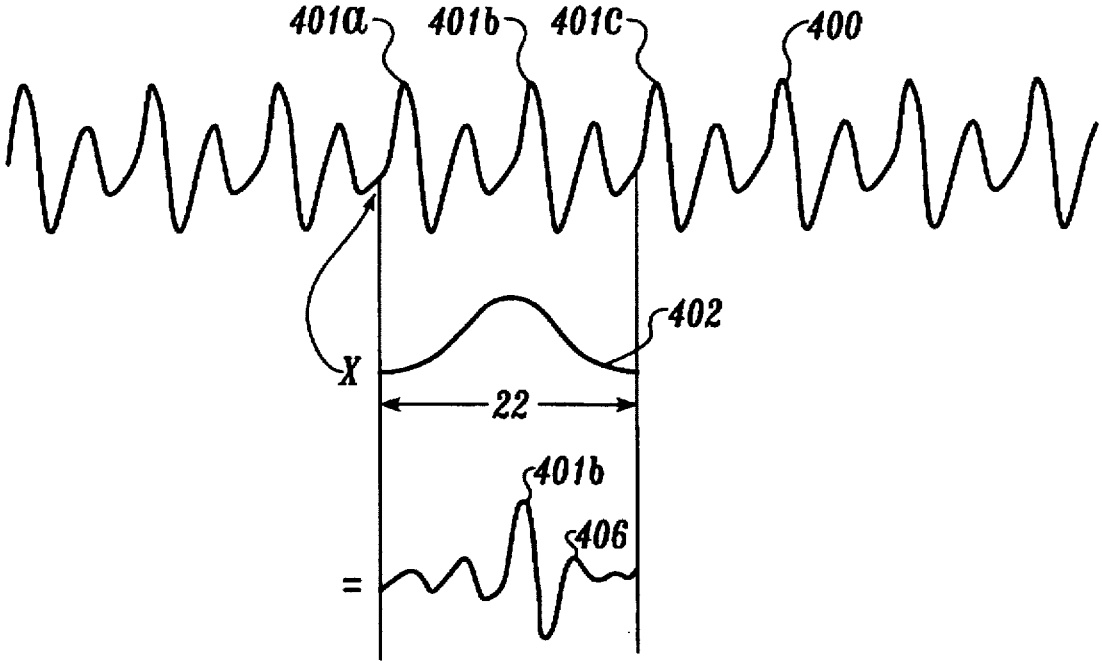
FIGS. 7A and 7B are a graphic representations of the method of shifting the pitch of a digitally sampled vocal signal according to the present invention.

With reference to FIG. 7, the pitch shifting routine operates by scaling a portion of the resampled input vocal signal 400 stored in the memory buffer with a window function 402 in order to reduce the magnitude of the samples at the beginning and end of the portion, and to maintain the value of the samples in the middle of the portion. The window function 402 is a smoothly varying, bell-shaped function that, in the preferred embodiment of the invention, is a Hanning window. The result of a point-by-point multiplication of the window function 402 and the portion of the resampled vocal signal 400 is a signal segment 406. As can be seen, the resampled vocal signal 400 contains a series of peaks 401*a*, 401*b*, 401*c* etc. The signal segment 406 contains a complete cycle (i.e. one peak) of the resampled data but has a beginning and an end that are relatively small in magnitude.

Figure 7B:
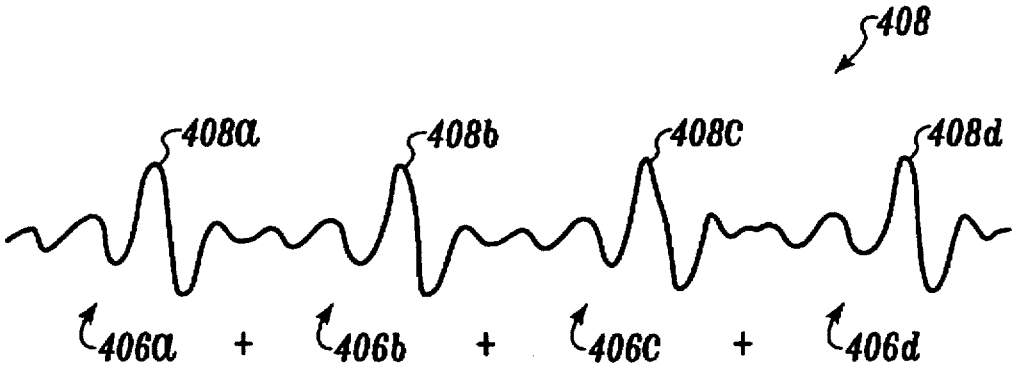

Referring now to FIG. 7B, a harmony note 408 is created by concatenating a series of signal segments 406*a*, 406*b*, 406*c* and 406*d* together. Comparing the harmony note 408 to the resampled vocal signal 400 (shown in FIG. 7A), it can be seen that the harmony note has half the number of peaks 408*a*, 408*b*, 408*c* as compared to the resampled data. Therefore, the harmony note 408 will sound an octave below the resampled vocal signal. As will be appreciated, the pitch of the harmony note to be created depends on the rate at which the signal segments, obtained by scaling the resampled vocal signal by the window function, are added together. As described in the '671 patent and in the Lent article, to shift the pitch of a note to any value higher than an octave below the original pitch requires that overlapping signal segments be added together. As will be appreciated, the reason for reducing the magnitude of the samples at the beginning and end of the signal segment is to prevent large variations in the harmony note as a result of adding overlapping signal segments together.

Figure 5:
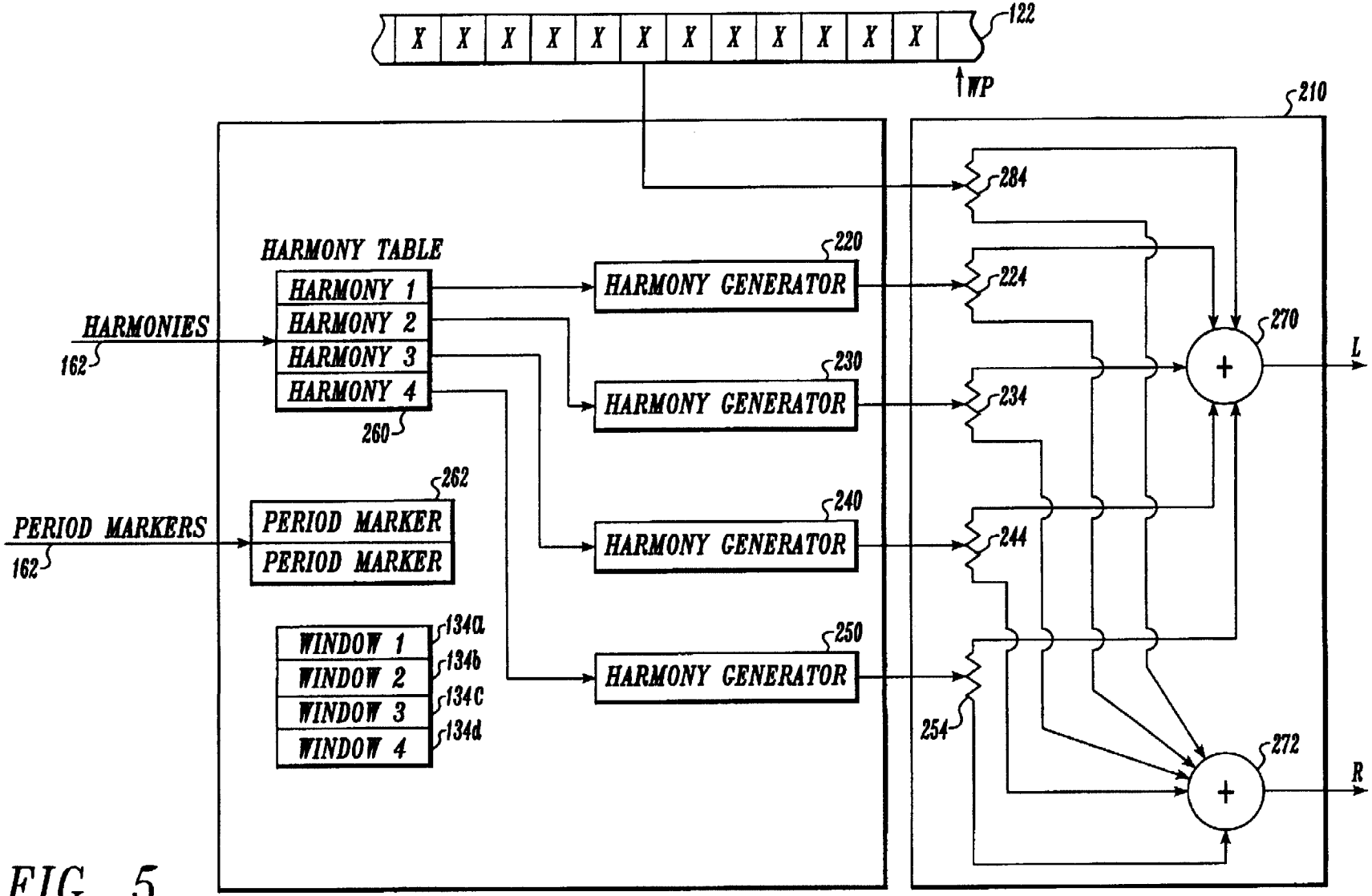
FIG. 5 is a block diagram showing the functions performed by a digital signal processor that is programmed according to the method of the present invention.
Figure 8A:
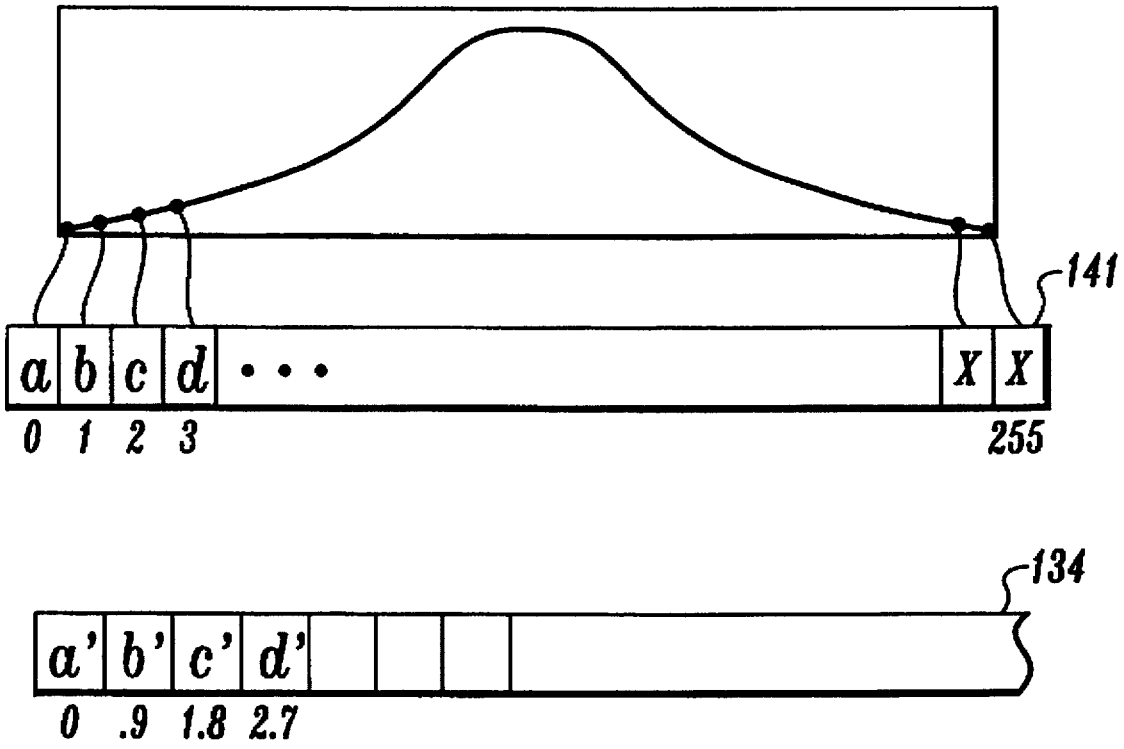
FIGS. 8A and 8B show how a Harming window is created and stored in memory in the method of the present invention.
Figure 8B:
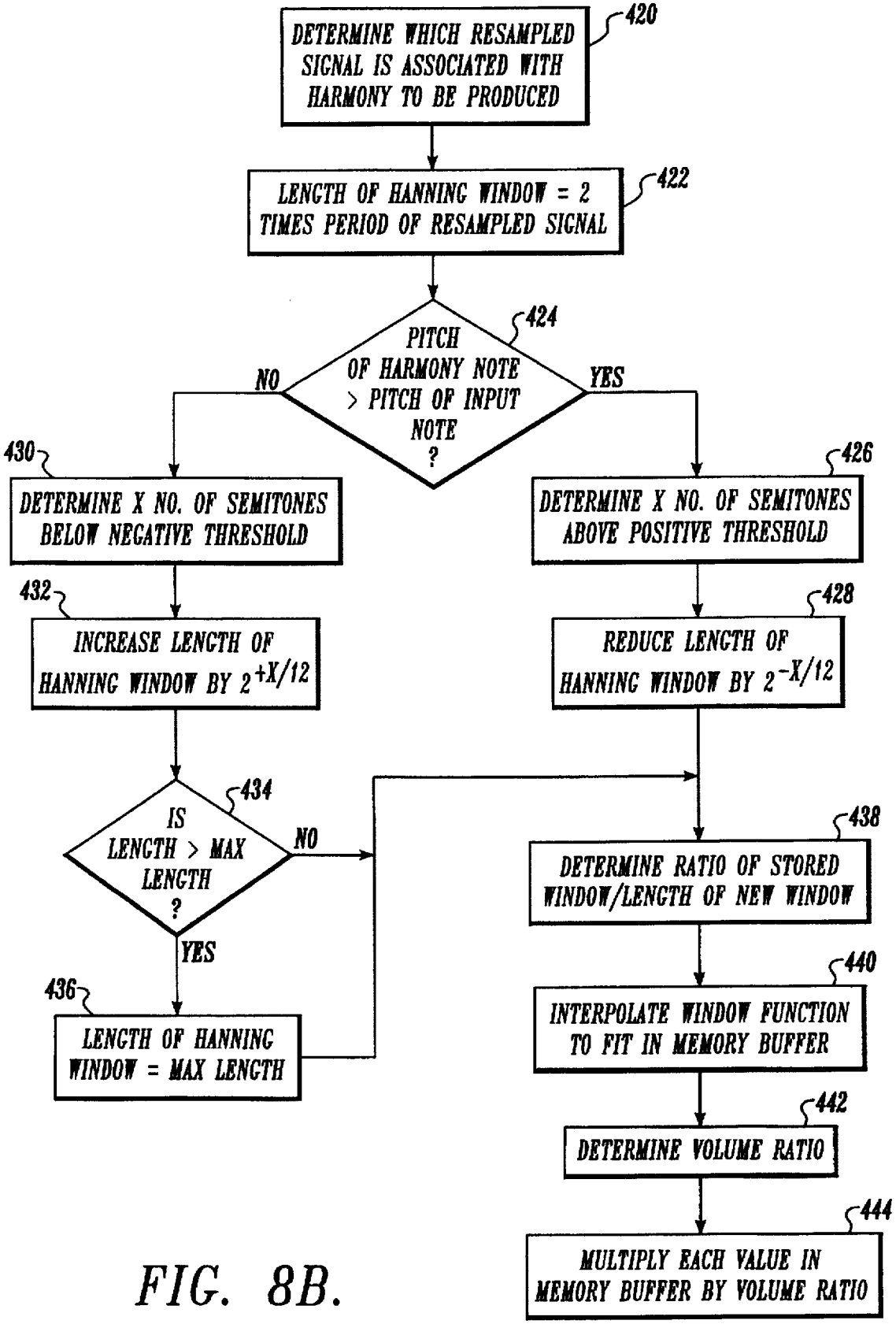

FIGS. 8A and 8B show how the digital signal processor calculates the Hanning windows used in creating the harmony notes. The window generation routine 196 described above stores mathematical representations of four Hanning windows in four memory buffers 134*a*, 134*b*, 134*c*, and 134*d* (FIG. 5). Each memory buffer 134*a*, 134*b*, 134*c* and 134*d* is associated with one of four harmony generators 220, 230, 240, and 250 (FIG. 5). Within the ROM 140 is a memory buffer 141 that stores a standard Hanning window in 256 memory locations. The values of the data a, b, c, d, etc. stored in the buffer are calculated by the raised cosine formula:

$$(1-\cos(2\pi x/256))$$

where x represents each sample stored in the buffer. To create a window function within one of the memory buffers 134 that is used to create the harmony notes, the length of the window is first determined and then the window is filled with new data points a', b', c', etc., by interpolating the values of the Hanning window stored in the memory buffer 141.

FIG. 8B is a flow chart of the steps performed by the window generation routine 196 (FIG. 3). Beginning at a step 420, it is determined which resampled input vocal signal is to be used to create the harmony note. For example, assume a user has set the gender controls to +10% and −10%. When using the musical effect 100, the user selects which resampled input vocal signal will be used to create a harmony note. The user can specify that the input vocal signal that is resampled at a rate of +10% is used to create a first harmony note, and the input vocal signal that is resampled at a rate of −10% is used to create the other harmony notes, etc.

Once the DSP has determined which resampled input vocal signal is to be used in creating the harmony notes, the length of the window function is initially set to equal twice the period of the associated resampled input signal (expressed in samples) at a step 422. Next, the pitch of the harmony note to be produced is compared with the pitch of the resampled input signal at a step 424. If the pitch of the harmony note is greater than the pitch of the resampled input note, the DSP proceeds to a step 426. At step 426, the DSP determines the number of semitones (x) the harmony note is above a positive threshold. In the presently preferred embodiment of the invention, the positive threshold is set to zero semitones. At a step 428, the length of the memory buffer that stores the Hanning window used to create the harmony note is reduced by multiplying the length calculated at step 422 by the results of the equation $$2^{-x/12}$$

where x is the number of semitones the harmony note is above the positive threshold. For example, if the harmony note is five semitones above the threshold, the length of the memory buffer is reduced by a factor of 0.75.

If the pitch of the harmony note to be created is below the pitch of the resampled input note, the length of the window may be expanded. At a step 430, the DSP determines the number of semitones (x) the harmony note is below a negative threshold. In the presently preferred embodiment, the negative threshold is 24 semitones below the pitch of the input note. If the harmony note is below the threshold, the length of the memory buffer that holds the window function is increased by an amount equal to the results of the equation:

$2^{1+x/12}$ where x is the number of semitones below the threshold. For example, if the harmony note to be created was 29 semitones below the pitch of the input note, then x=5 and the length of the memory buffer that holds the window function is increased by a factor of 1.33.

At a step 434, it is determined whether the length of the window function has been increased to an amount that is greater than the amount of memory available to store the window function. If so, the length of the window function is set to the maximum amount of memory available to store the window function.

If the harmony note to be created is not below the negative threshold, the length of the window function remains the same as was calculated in step 422.

After the length of the memory buffer that holds the window function has been calculated, the memory buffer 134 is filled with the values of the window data. This is accomplished by determining, at step 438, a ratio of the length of the buffer 141 (which is currently 256) to the length of the buffer as determined by steps 428 or 432. This ratio is used in step 440 to interpolate the window data. For example, if the new buffer has a length of 284 samples, the buffer 134 is completed by interpolating the data at points 0, 0.9, 1.8, 2.7 in the same manner as the input vocal signal is resampled as shown in FIGS. 4A, 4B and described above.

A user can also specify a volume ratio for each harmony note produced. This volume ratio affects the magnitude of the samples stored in the memory buffer 134. If the user wants full volume for the harmony notes, the ratio is set to one. If the user wants half the volume, the ratio is set to 0.5. The volume ratio is determined at step 440 and each value in the memory buffers 134 is multiplied by the volume ratio at a step 442.

Returning to FIG. 3, the output of the pitch shifting routine 200 is supplied to a summation block 210 where the output is added to the dry audio signal stored in the memory buffer 122. The combination of the dry audio signal and harmony signals is supplied to a digital-to-analog converter 215 that produces a multi-voice analog signal that is the combination of the input note and harmony notes. As is described in the '671 patent, the output harmony notes are not produced if the pitch recognition routine detects that a user has sung a sibilant sound. Sibilant sounds are sounds such as "s," "ch," "sh," etc. In order for the harmony notes to sound realistic, the pitch of these signals is not shifted. If the pitch recognition routine detects that the user has sung a sibilant sound, the microprocessor sets all the harmonies to be produced to be the same pitch of the input vocal signal. Thus, the harmony notes will all have the same pitch as the input vocal signal, but they will sound slightly different than the input signal due to the timbre shift that occurs due to the combined operation of the resampling and the operation of the pitch shifting routine 200.

In order to produce more natural sounding harmonies than could be obtained using prior art pitch shifting techniques, the present invention replicates a portion of the resampled input vocal signal that is already pitch and timbre shifted as a result of the resampling. Turning now to FIG. 5, the pitch shifting routine 200 performed by the digital signal processor 180 is accomplished using the series of harmony generators 220, 230, 240 and 250. Each harmony generator produces one harmony note that is mixed with the dry audio signal stored in the memory buffer 122. The harmony notes to be created are supplied to the digital signal processor on a lead 162 and stored in a look up table 260. The look up table within the digital signal processor is used to determine the fundamental frequency for each of the harmony notes.

Each harmony generator within the digital signal processor produces one of the harmony notes stored in the look up table 260. As described above, the harmony generators scale one of the resampled input vocal signals with the Hanning window stored in the harmony generator's associated memory buffer 134*a*, 134*b*, 134*c*, or 134*d*, at a rate equal to the fundamental frequency of the harmony note to be created.

The dry audio signal and the output signal of each of the harmony generators 220, 230, 240 and 250 is supplied to the summation block 210 that divides the signals between left and fight channels. For example, the output of harmony generator 220 is supplied to a mixer 224. The mixer allows the user to direct the harmony produced to either a left or right audio channel or to a mix of the right and left audio channels. Similarly, the outputs of the harmony generators 230, 240 and 250 are fed to corresponding mixers 234, 244 and 254. Each of the mixers feeds a summation block 270 that combines all the harmony signals for the left channel. Similarly, each of the mixers 224, 234, 244 and 254 feeds a summation block 272 that combines all the harmony signals for the right audio channel.

The digital signal processor also reads the dry audio signal from the memory buffer 122 and applies it to a mixer 284 that can be operated by the user to direct the dry audio to the some combination of the left and/or fight audio channels.

Although the digital signal processor 180 is shown including four harmony generators, those skilled in the art will recognize that more or less harmony generators could be provided depending upon the memory available and processing speed of the digital signal processor.

Figure 6:
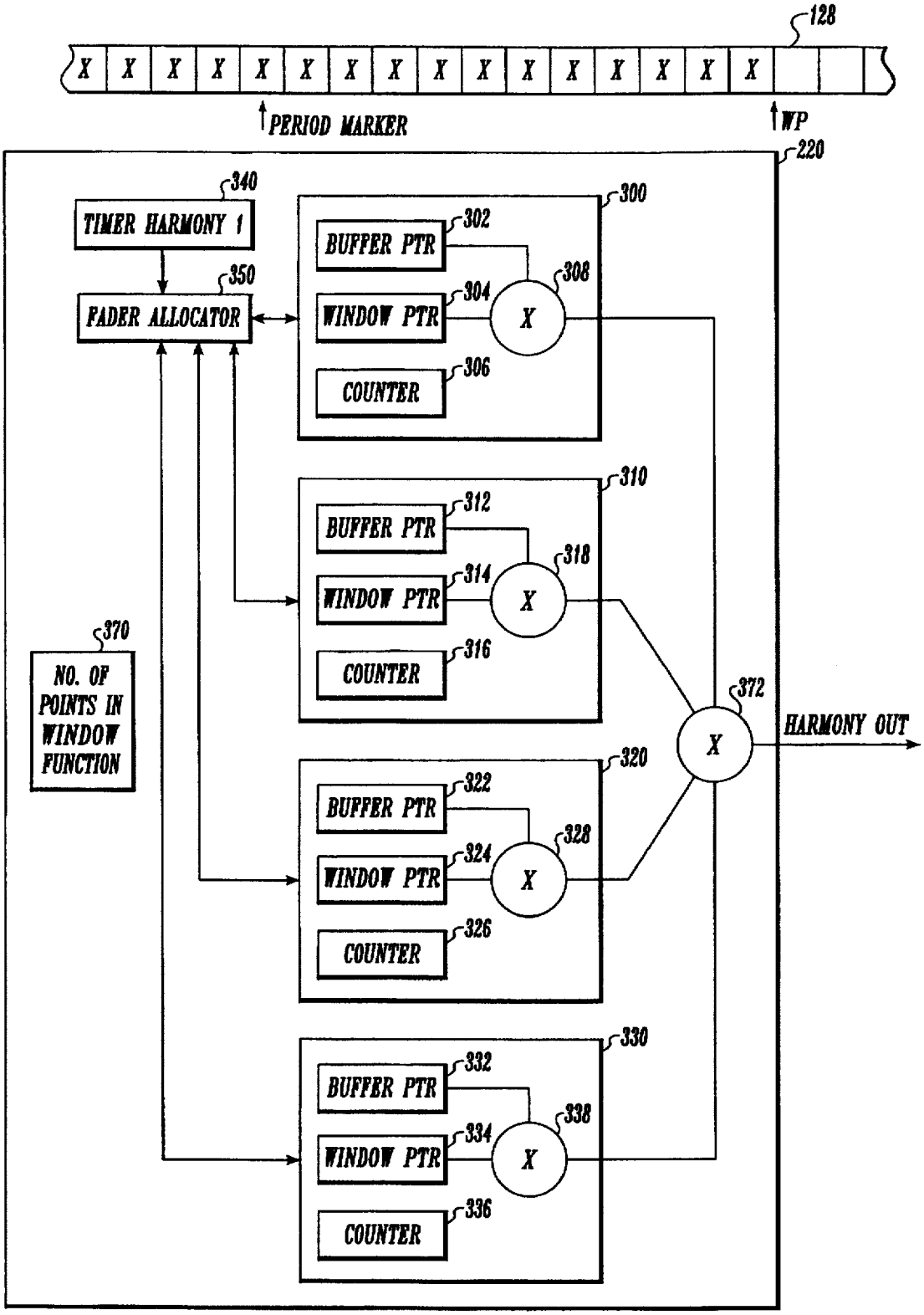
FIG. 6 is a block diagram showing the functions performed by a windowed audio generator unit within the digital signal processor.

Turning now to FIG. 6, the details of the functions performed by each of the harmony generators are shown. Each of the harmony generators includes a plurality of windowed audio generators 300, 310, 320 and 330. Each windowed audio generator operates to scale the resampled input vocal signal by the Hanning window as described above. A timer 340 within the windowed audio generator is supplied with a value equal to the fundamental frequency of the harmony note to be produced. The fundamental frequency is determined from the look up table 260 (shown in FIG. 5) that correlates each harmony note with its corresponding fundamental frequency. When the timer 340 counts down to zero, a signal is sent to a windowed audio generator allocation block 350 that looks for one of the windowed audio generators 300, 310, 320 or 330 to begin the scaling process. For example, if the windowed audio generator 300 is not in use, a buffer pointer 302 is first loaded with the value of the period marker that marks the location in the memory buffer 128 where a complete cycle of the resampled input vocal signal that is to be used in creating the harmony signal begins. Next a window pointer 304 is loaded with a pointer to the beginning of the harmony generators associated memory buffer 134*a*, 134*b*, 134*c*, or 134*d* (FIG. 5). Finally a counter 306 is loaded with the number of samples that are used to store the selected window function. The number of samples in the window function is supplied by the digital signal processor to the harmony generators and is stored in a memory location 370 for use by all the windowed audio generators.

After the buffer pointer 302, the window pointer 304, and counter 306 are initialized, the windowed audio generator then begins a point-by-point multiplication of the resampled input vocal signal stored in the associated memory buffer 128 and the Hanning window stored in associated memory buffer. The result of the multiplication is applied to a summation block 372 that adds the output from all the windowed audio generators 300, 310, 320 and 330. After the multiplication is completed, the pointers 302 and 304 are advanced and the counter 306 is decremented. When the counter 306 reaches zero and all the multiplications have been performed, the windowed audio generator signals the windowed audio generator allocation block 350 that it is available to be used again. The windowed audio generators 310, 320 and 330 operate in the same manner as the windowed audio generator 300.

The timer 340, the period markers stored in the memory location 262 (FIG. 5), the number of points in the window function stored in the memory location 370, and the Hanning windows stored in the memory locations 134 are all dynamically updated as the user sings different notes into the microphone.

As described above, for harmony notes having a pitch below the pitch of the input vocal signal, the Hanning window is calculated to have a length equal to, or longer than, twice the period of the input signal used to create the harmony signal. Therefore, to create a harmony signal that is an octave below the input vocal signal, only one windowed audio generator is needed. However, to create harmony notes having a pitch greater than the pitch of the input vocal note, the length of the Harming window is shortened. Therefore, to produce an output signal that is above the pitch of the resampled input vocal signal requires only two windowed audio generators.

While the preferred embodiment of the invention has been illustrated and described, it will be appreciated that various changes can be made therein without departing from the spirit and scope of the invention. For example, although the present invention has been described with respect to vocal harmony generators, the invention also has other uses. One example is as a voice disguiser, where a user would speak into a microphone and an output signal having a different timbre and/or pitch would be produced. If the output signal had a frequency one octave below the input signal, a device could be built wherein the mount of pitch shift used in data resampling is fixed and that requires only one windowed audio generator. Such a device would be useful for law enforcement to disguise the voice of witnesses or as part of an answering machine to conceal the voice of the user. Alternatively, the present invention could be used by radio announcers who want their voice to sound deeper. In addition, the invention can be used with input notes that are received from musical instruments. The result of the timbre shitting combined with pitch shifting allows one instrument to sound like another.

Additionally, the preferred embodiment of the invention first employs the resampling pitch shifting followed by the pitch shifting according to the Lent method. It will be appreciated that the reverse process could also be used, whereby the output signals created using the Lent method are stored in a memory buffer and resampled at a new rate to further shift the pitch. Therefore, the scope of the invention is to be determined solely from the following claims.

The embodiments of the invention in which an exclusive property or privilege is claimed are defined as follows:

1. A method of creating a timbre shifted output signal from an input signal, comprising the steps of:

receiving a digital representation of an input signal that has been sampled at a first rate;

storing the digital representation of the input signal in a digital memory;

resampling the digital representation of the input signal at a second rate that differs from the first rate; and creating a digital representation of the timbre shifted output signal by replicating a portion of the resampled digital representation of the input signal.

2. The method of claim 1, further comprising the steps of applying the digital representation of the timbre shifted output signal to an digital-to-analog converter to convert the digital representation of the timbre shifted output signal to an analog representation of the timbre shifted output signal.

3. The method of claim 1, wherein the step of receiving a digital representation of the input signal comprises the steps of:

receiving an analog representation of the input signal; and applying the analog representation of the input signal to an analog-to-digital converter to convert the analog representation of the input signal to a digital representation of the input signal.

4. The method of claim 1, wherein the input signal is a note produced by a musical instrument.

5. The method of claim 1, wherein the input signal is a vocal note.

6. The method of claim 1, wherein the input signal has a fundamental frequency and wherein the output signal has a fundamental frequency that is different than the fundamental frequency of the input signal.

7. A method of generating an output vocal signal from an input vocal signal, comprising the steps of:

receiving a digital representation of the input vocal signal that has been sampled at a first rate;

storing the sampled input vocal signal in a digital memory;

resampling the stored input vocal signal at a second sampling rate different from the first rate to create a resampled input vocal signal; and replicating a portion of the resampled input vocal signal by periodically scaling the resampled input vocal signal with a window function to create the output vocal signal.

8. The method of claim 7, wherein the step of receiving a digital representation of the input vocal signal comprises the steps of:

receiving an analog representation of the input vocal signal; and applying the analog representation of the input vocal signal to an analog-to-digital converter to convert the analog representation of the input vocal signal to a digital representation of the input vocal signal.

9. The method of claim 7, wherein the input vocal signal has a fundamental frequency and the output vocal signal has a fundamental frequency that is different from the fundamental frequency of the input vocal signal.

10. The method of claim 7, wherein the input vocal signal and the output vocal signal have a fundamental frequency and wherein the step of scaling a portion of the resampled input vocal signal further comprises the steps of:

generating a window function having a duration that is a function of a difference between the fundamental frequency of the input vocal signal and the fundamental frequency of the output vocal signal; and multiplying the window function and the resampled input vocal signal together.

11. The method of claim 7, wherein the digital representation of the input vocal signal comprises a number of cycles, each cycle occupying a number of memory locations, the method further comprising the steps of:

storing the resampled input vocal signal in a larger number of memory locations per cycle than are occupied by the digital representation of the input vocal signal if the second sampling rate is faster than the first sampling rate; and storing the resampled input vocal signal in a fewer number of memory locations per cycle than are occupied by the digital representation of the input vocal signal if the second sampling rate is slower than the first sampling rate.

12. The method of claim 7, wherein the step of resampling the stored input vocal signal is performed by interpolating the digital representation of the input vocal signal stored in the digital memory.

13. The method of claim 12, where the step of interpolating the digital representation of the input vocal signal is performed using a linear interpolation.

14. An apparatus for producing a timbre shifted output signal from an input signal, comprising:

a digital memory;

a digital signal processor for receiving a digital representation of the input signal and for storing the digital representation of the input signal in the digital memory;

means for resampling the digital representation of the input signal that is stored in the digital memory at a second rate that differs from the first rate, and for storing the resampled digital signal in the digital memory; and means for periodically replicating a portion of the resampled digital signal to produce a digital representation of the timbre shifted output signal.

15. The apparatus of claim 14, further comprising:

a microphone for converting the input signal into a corresponding electrical input signal;

an analog-to-digital converter for sampling the electrical input signal at the first rate and converting the electrical input signal into a digital representation of the input signal.

16. The apparatus of claim 14, further comprising a control for varying the second rate at which the input signal is resampled.

17. The apparatus of claim 14, further comprising means for receiving a signal that is indicative of a desired pitch of the timbre shifted output signal.

18. The apparatus of claim 14, wherein the means for replicating a portion of the resampled input signal scales the resampled input signal with a window function.

19. The apparatus of claim 14, wherein the input signal and the timbre shifted output signal have a fundamental frequency and wherein the digital signal processor further comprises:

means for adjusting a duration of the window function based upon a difference between the fundamental frequency of the input signal and the fundamental frequency of the timbre shifted output signal.

20. The apparatus of claim 19, wherein the means for adjusting the duration of the window function decreases the duration of the window if the fundamental frequency of the timbre shifted output signal is greater than the fundamental frequency of the input signal and increases the duration of the window function if the fundamental frequency of the timbre shifted output signal is less than the fundamental frequency of the input signal.

21. The apparatus of claim 14, wherein the means for producing the digital representation of the timbre shifted output signal scales the resampled input signal at a rate that is musically harmonic with the input signal.

22. A method of creating a digital representation of a timbre shifted output signal from a digital representation of an input signal that has been sampled at a first rate, comprising the steps of:

storing the digital representation of the input signal in a digital memory;

creating a digital representation of a pitch shifted signal by replicating a portion of the stored digital representation of the input signal;

storing the digital representation of the pitch shifted signal in the digital memory; and resampling the stored digital representation of the pitch shifted signal at a second rate that differs from the first rate to create the digital representative of the timbre shifted output signal.

23. A method of creating a digital representation of a timbre shifted output signal from an electrical signal that is representative of an input signal, comprising the steps of:

sampling the electrical signal that is representative of the input signal at a first rate to create a digital representation of the input signal;

storing the digital representation of the input signal in a digital memory;

creating a digital representation of a pitch shifted signal by replicating a portion of the stored digital representation of the input signal;

storing the digital representation of the pitch shifted signal in the digital memory; and resampling the stored digital representation of the pitch shifted signal at a second rate that differs from the first rate to create the digital representation of the timbre shifted output signal.

* * * * *

UNITED STATES PATENT AND TRADEMARK OFFICE

CERTIFICATE OF CORRECTION

PATENT NO. : 5,641,926

DATED : Jun. 24, 1997

INVENTOR(S) : Gibson et al.

It is certified that error appears in the above-indentified patent and that said Letters Patent is hereby corrected as shown below:

On the title page:

Item [73] "Technologis" should read --Technologies--.

Column 2, line 52, "shitting" should read --shifting--.

Column 3, line 10, "Harming" should read --Hanning--.

Column 4, line 12, "shitting" should read --shifting--.

Column 4, line 52, "desked" should read --desired--.

Column 7, line 63, "era" should read --of a--.

Column 7, line 67, "(pro)" should read --(pm)--.

Column 12, lines 15 and 29, "fight" should read --right--.

Column 13, line 27,"Harming" should read --Hanning--.

Signed and Sealed this

Twenty-third Day of September, 1997

*Attest:*

Bruce Lehman

BRUCE LEHMAN

*Attesting Officer*

*Commissioner of Patents and Trademarks*